United States Patent [19]

Biesinger

[11] Patent Number: 4,573,958

[45] Date of Patent: Mar. 4, 1986

[54] CUTTLING MACHINE FOR CONTINUOUS INPUT OF WEB

[76] Inventor: Peter J. Biesinger, Saumstr. 15, Herbertingen, Fed. Rep. of Germany, D-7944

[21] Appl. No.: 627,871

[22] Filed: Jul. 3, 1984

[30] Foreign Application Priority Data

May 8, 1984 [DE] Fed. Rep. of Germany ..... 8413894

[51] Int. Cl.[4] ..... B31F 1/00

[52] U.S. Cl. ..... 493/415; 493/413; 493/414; 493/470

[58] Field of Search ..... 493/411, 412, 413, 414, 493/415, 416, 417, 421, 422, 434, 435, 442, 454, 410, 470; 26/80, 83, 84; 74/130, 131

[56] References Cited

U.S. PATENT DOCUMENTS

| | | | |
|---|---|---|---|
| 1,113,905 | 10/1914 | Pease | 26/80 |
| 2,250,572 | 7/1941 | Cumfer | 493/415 |
| 2,440,209 | 4/1948 | Redman | 493/413 |
| 3,083,008 | 3/1963 | Miller | 493/415 |
| 3,119,168 | 1/1964 | Fleissner | 26/84 |
| 3,640,521 | 2/1972 | Hutley | 493/416 |
| 4,074,901 | 2/1978 | Catallo | 493/413 |
| 4,358,285 | 11/1982 | Fujino | 493/411 |
| 4,493,689 | 1/1985 | Affüpper | 493/411 |

FOREIGN PATENT DOCUMENTS

| | | | |
|---|---|---|---|
| 539123 | 4/1957 | Canada | 74/131 |

OTHER PUBLICATIONS

Utica Ball Bearing Spreader for Lag Up Machine, 5/10/1977, Utica Mill Specialty Machinery Co., Inc.

*Primary Examiner*—Francis S. Husar
*Assistant Examiner*—Robert Showalter
*Attorney, Agent, or Firm*—Holman & Stern

[57] ABSTRACT

Flat tubular web is supplied from a textile finishing machine and cooled down by jets in a cooling unit to the room temperature or thereunder and dried in the process. The web is then passed by a laying unit onto a table in the form of a folded stack. The laying unit comprises a reciprocating carriage that is moved by an endless chain with a sliding member thereon running in a slide on the carriage. The carriage is supported on parallel rods. There is a tenter placed inside the web tube and over two rotating bars in the carriage. The web passes between the bars on its way to the stack. The bars are driven by a stationary double chain acting as a rack and by sprocket wheels which are connected with the bars by freewheels such that the bars are driven alternately as the carriage is reciprocated. When the stack has grown to the desired height the table operates a limit switch for operation of a clearing conveyor for removing the stack sideways.

11 Claims, 7 Drawing Figures

CUTTLING MACHINE FOR CONTINUOUS INPUT OF WEB

BACKGROUND OF THE INVENTION

1. Field of the Invention

The present invention relates to cuttling or folding machines for folding up continuously supplied, and more specially flat tubular, textile web as a stack, comprising a stack support table and a pair of rotating bars transporting the web running therebetween and reciprocating over the folding table in a direction normal to their axes, and means for lowering the folding table in steps, one such step taking place after a whole number of strokes of the laying bars through a distance equal to a whole number of thicknesses of plies in which the material is laid on the support table.

2. Description of the Prior Art

In the prior art a number of different designs of cuttling machines for folding flat tubular web have been proposed. In such machines the supplied web of material undergoes relaxation treatment before or after coming off the textile finishing machine, such relaxation or stress-relief generally comprising heating, then quenching and further transport in a loose condition. To make it possible for such web material to be placed neatly in a folded stack without the tension or stress of the material being modified, the material is run downwards through the two laying bars, that are usually placed over the folding table, on a reciprocating rocking carrier. There are means for lowering and lifting the table. The table is lowered in steps at the end of each stroke of the bars, the operation going on till the length of web has all been folded or the stack of plies on the table has reached a given height.

Because in this known cuttling machine the distance between the laying bars and the top of the stack of plies is constantly changing, neat and regular folding or laying is not possible, the machine more specially leaving much to be desired in this respect when the table is only lowered after more than one ply has been laid.

In order to enhance the neatness and regularity of the folding operation machines have been designed in which the support table and not the laying bars are reciprocated. The table then had to have means for moving it vertically, incrementally in steps, for moving it vertically, continuously and furthermore for reciprocating it sideways. Such a table driving and control system was expensive, elaborate and likely to get out of order. Because there were two guides with one being guided by the other there was a cumulative effect with respect to inaccuracies in the guides so that laying in plies was not regular, and furthermore there was an increase in irregularity as the folded pile grew in height.

BRIEF SUMMARY OF THE INVENTION

The starting point of the present invention is a folding machine of the types referred to above and one object of the invention is to make such an improved design of the machine that the folding operation becomes more regular.

A still further purpose of the invention is to redesign such machines so that the folding rate is stepped up.

In order to effect these and further objects of the invention that will be seen on further reading of the present description, the laying bars are bearinged in a laying carriage which moves parallel to the laying plane of the support table in a direction normal to the axes of rotation of the laying bars and may be driven by a laying drive with regular points of reversal of its motion, the laying bars being driven by cooperation with stationary reference driving means, as for example racks.

It will be seen from this that the table only has to be moved upwards and downwards, as in the one form of prior art machine, whereas the reciprocating motion for laying the web is undertaken by a laying carriage which, with respect to the laying stroke and the guiding of the web onto the stack, may be more accurately set and adjusted than the support table, this making possible a minimum clearance between the laying bars and the top of the stack so that it is then possible for one of the two laying bars to roll on and over the ply of web that is in the process of being folded onto the top of the stack. To increase the regularity of the laying operation the stack of plies may furthermore be compacted somewhat so that the stack may be stored for a longer time without the plies thereof slipping in relation to each other. This is important if the plies of the stack are to be cut at the same time to make parts of garments, because, if there is no relative shifting of the plies, there will be less wastage.

BRIEF DESCRIPTION OF THE DRAWINGS

Further details and useful effects of the invention will be seen from the detailed description below with reference to the accompanying drawings wherein.

DETAILED DESCRIPTION

Figure 1:
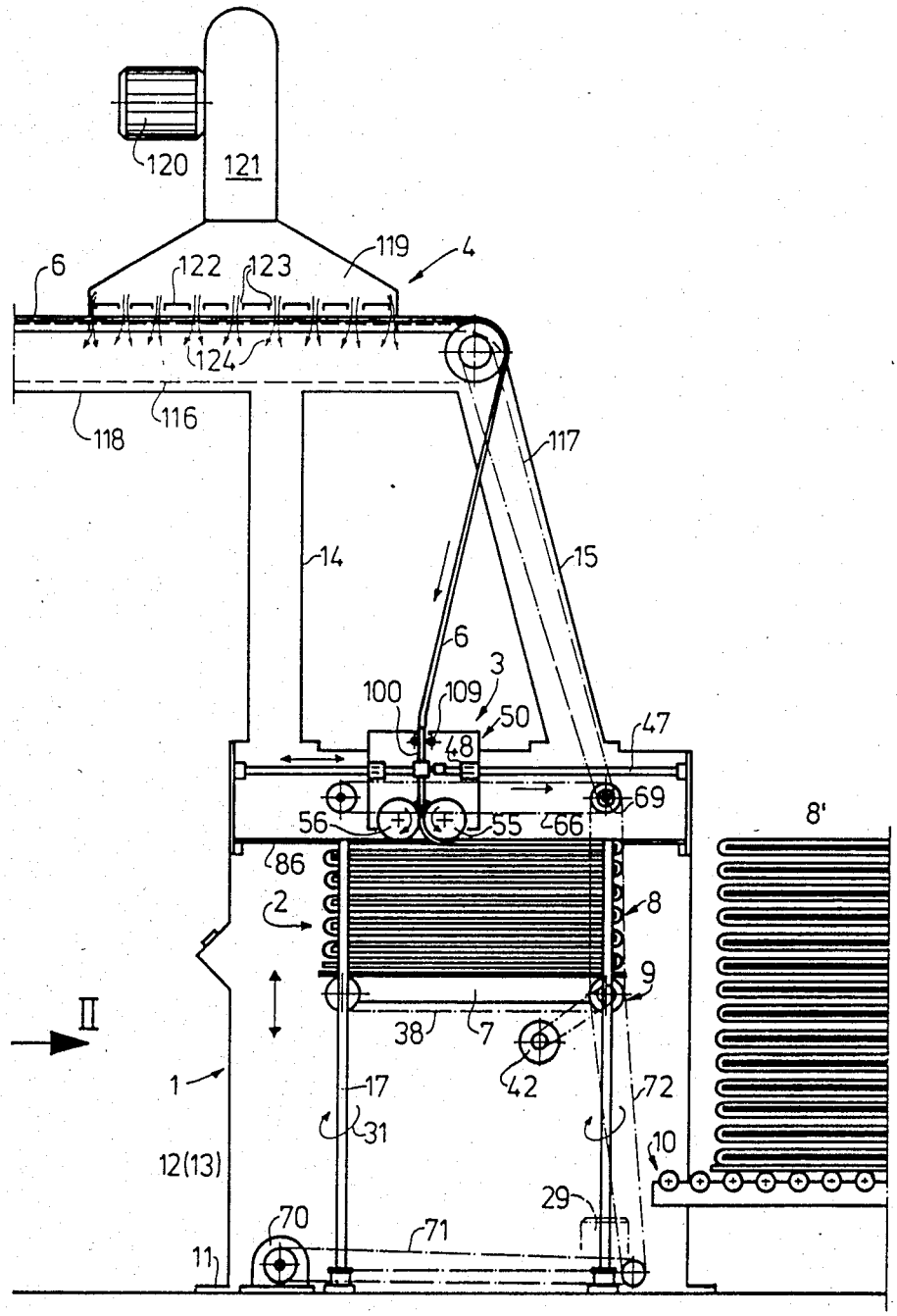
FIG. 1 is a diagrammatic side elevational view of the cuttling or folding machine of the present invention having an overhead cooling unit, the front wall being omitted.

The cuttling or folding and stacking machine to be seen in the figures comprises a machine frame 1 placed around at least two opposite sides of a table unit 2 with a clearing conveyor 9. On top of the frame 1 there is a laying unit 3 and a cooling and supply unit 4.

The textile web 6 in the form of a flat tube firstly runs through the cooling and supply unit 4 and the laying unit 3 by which it is laid zig-zag on the table 7 of the table unit 2 as a stack 8 of plies. While this is taking place the table 7 is lowered in steps and at the same rate as the web is laid thereon. When the top face of the table 7 is on the same level as the roller conveyor 10 next to it, the laid stack 8 is shifted by the clearing conveyor 9 at least as far as the position 8' in which it is on the roller conveyor 10 and is clear of the table 7.

The machine frame

It will be seen that there is a base plate 11 with two mainly box-like side legs 12 and 13 thereon, that are joined together by sideways stays (not shown) so as to make up a stiff framework. As we will see later on, the machine frame supports a number of subsidiary parts of the table unit 2 and of the laying unit 3.

The cooling and supply unit 4 is mounted on the two side legs by way of two struts 14 and 15 placed on the two legs 12 and 13.

The table unit

At the four corners of the table 7 four nuts 16 are fixed in place and engage with four upright driving screws 17 or screw rods, whose lower ends are mounted in lower end bearings 18. If the table has no additional means for vertically guiding it, then there will be top end bearings for the driving screws 17.

A small distance above each of the lower end bearings 18 each driving screw 17 has a sprocket wheel 19 keyed thereon, around which a common driving chain 20 is slung. The chain 20 is tensioned by a sprocket wheel 21 mounted on the free end of a tensioning lever 22, which is rockingly mounted on the machine frame by a bearing 23 and is acted upon by a spring (not figured) so that the sprocket wheel 21 is kept pressed against the chain 20 to keep it in a taut condition.

One of the four driving screws 17 has a further sprocket wheel 26 keyed thereon that by way of a further chain 27 is driven by a drive motor 29 that has a sprocket wheel 28. All shafts and drive screws of the table lifting system so formed are placed vertically and all four drive screws 17 are turned in the same direction as marked by the arrows 31.

The table lift motor 29 may, generally speaking, be a variable speed motor. It may furthermore be a reversing motor whose direction of rotation is changed by reversing the direction of current flowing therethrough and which lifts the table at a speed of about 30 meters a minute and lowers it at a speed of 9 meters a minute.

In a manner that is still to be described, when laying or folding is taking place, the table is lowered in steps, one such step coming after each laying stroke. In this respect the amount the table is lowered is dependent on the time the drive motor 29 is switched on, such time being worked out in each case having regard to the thickness and nature of the textile web.

The clearing conveyor

On two opposite ends of the table 7 two shafts 36 are turningly mounted, which each have four pulleys 37 thereon so placed that the pulleys on the one shaft are paired with those of the opposite shaft. One flat belt 38 is slung over each pair of such pulleys so that the top run of each such belt runs over the top even face 39 of the table 7 and with the other belts supports a palet 40 with the stack 8 thereon. The palet will mostly be made of paperboard. There is a small clearance between the top face 39 of the table and the palet 40. The stack 8 is built up on the palet 40.

One of the two shafts 36 is joined up by way of a v-belt drive or some other similar belt transmission 41 with a clearing motor 42, that is controlled by a limit switch 43 which is tripped by the table 7. Once the table 7 has engaged the limit switch 43 in its lowermost position, the clearing motor 42 is kept on by a timer for a time long enough to see that the palet 40 with the laid stack 8 has been pushed onto the roller conveyor 10. When the timer has switched itself off again, the lifting motor 29 is switched on automatically in the lifting direction at its fast speed and it lifts the table 7 upwards till it is in its top end position.

The laying unit 3

Figure 5:
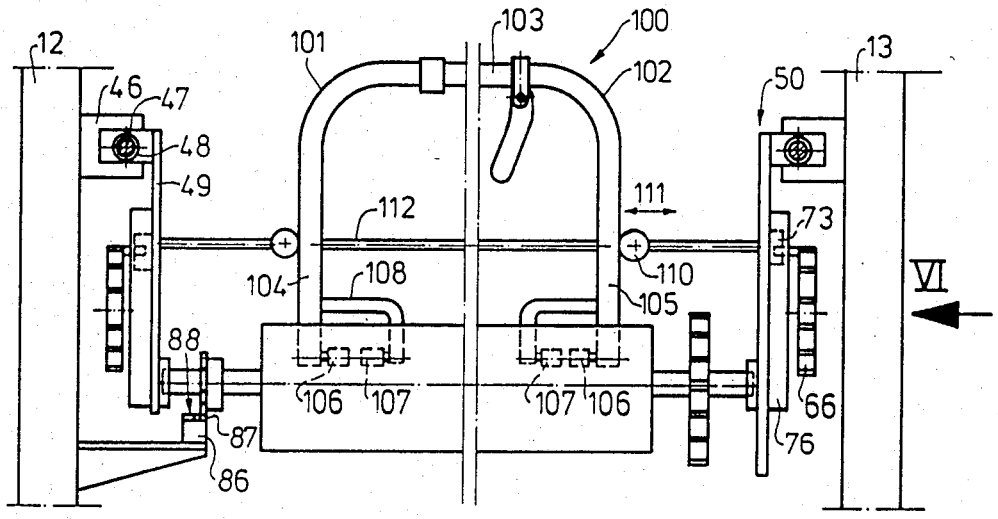
FIG. 5 is a bottom plan view of the system of FIG. 4; as seen from below.
Figure 6:
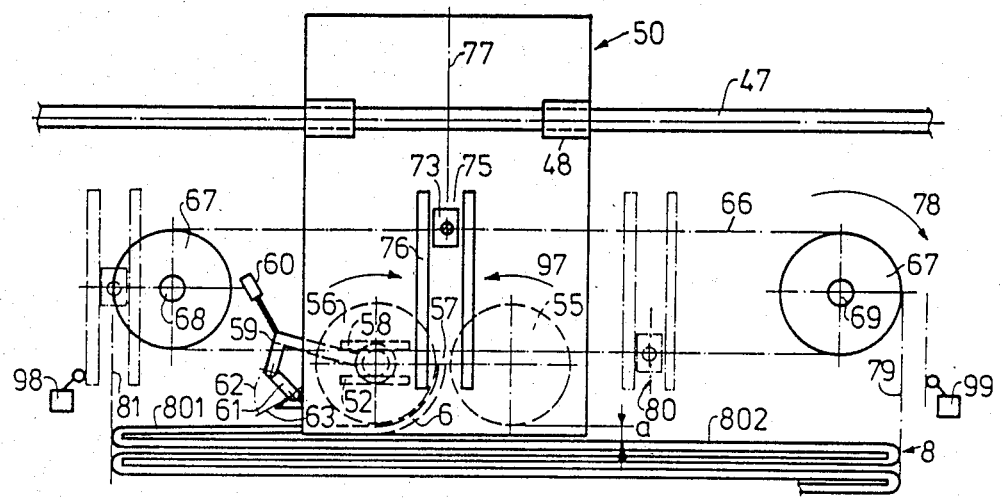
FIG. 6 is a view of the laying carriage with the drive system looking in the direction of the arrow VI in FIG. 5.

As may best be seen from FIGS. 1, 5 and 6, towards the top ends of the box-like legs 12 and 13 there are cylindrical guide rods 47 whose ends are fixed in brackets 46 (FIG. 5). These rods 47 form a bed for a laying carriage 50, which is connected with the rods by two side plates 49. The side plates are supported on the rods by bushes 48 with linear ball bearings therein. These side plates 49 furthermore have rolling element bearings 51 and 52 in which the shafts 53 and 54 of the laying bars 55 and 56 are supported so that there is a gap 57 therebetween.

As will best be seen from FIG. 6, the rolling element bearings 52 of one of the bars 56 are mounted in slides 58 at the ends of the bar and are joined with the free ends of two bell cranks 59 which have a handle 60 at their ends, the parts of the cranks running down at 61 from the ends being pivoted so that on rocking the cranks 59 counter clockwise as shown in FIG. 6 in the direction 62 the cranks are moved into self-locking end positions 63 in which the laying bar 56 is moved further from the other laying bar 55 and the gap 57 therebetween is opened up. There is a spring (not shown) for loading the laying bar 56 towards the laying bar 55.

The laying carriage 50 is reciprocated by two endless chains 66, that may be in the form of endless roller or rollerless plate link chains running on sprocket wheels 67, that for their part are keyed on arbors 68 and 69. These arbors have their ends mounted in bearings in the side legs 12 and 13 of the machine frame. The arbor 69 is driven by the laying motor 70 by way of two chain transmissions 71 and 72.

Figure 4:
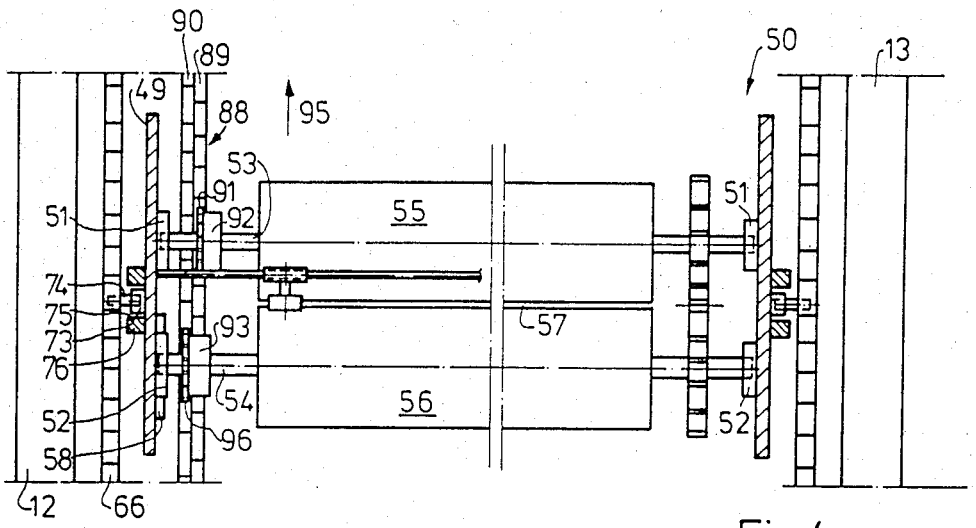
FIG. 4 is a partly cut away diagrammatic top plan view of the laying or folding bars and their drive.

Two links of the chains 66 that are opposite to each other bear sliding members 73 that are each turningly mounted on a pin 74, see FIGS. 4 and 5. The sliding members 73 are free to slide up and down in two upright guide grooves 75 between two guide rails 76, which are each fixed on the side plates 49 of the laying carriage 50.

As will be seen from the operational position marked in full lines in the middle of FIG. 6, the sliding member 73, the guide groove 75 and the laying gap 57 between the bars are in the same transverse plane 77 of the laying carriage 50. When the chain 66 is turned in the direction marked by arrow 78 this transverse plane will move in FIG. 6 firstly as far as the first reversal plane 79 and then through an in between position 80 at the left hand reversal plane 81 back into the middle position as marked in the Figure. The reversal of the direction of motion of the laying carriage 50 takes place with sine law acceleration and deceleration so that it is gently braked and speeded up again. This being so, the separate folds 82 at the ends of the plies 801 and 802 are placed quite regularly and neatly in the reversal planes 79 and 81, this process being aided by the generally playfree mounting system using linear ball bearing bushes 48.

A further contribution to the accuracy or regularity of laying of the web in plies is made by the design of the drive for the laying bars 55 and 56. As will be seen from FIG. 5, there is a bracket beam 86 or ledge mounted on the inner side of the leg 12 so as to run in the lengthways direction, with a stage 87 thereon parallel to the table 7.

A double roller chain 88 with two series of pintles 89 and 90 is mounted on the top of the ledge 86 for meshing with two sprocket wheels 91 and 96, that are joined with the ends of the bars 55 and 56 by way of freewheels 92 and 93 with opposite directions of operation.

Because of the presence of the freewheels 92 and 93 only one of the laying bars is turned at a time, this being the one resting on the topmost ply 801 of the stack 8. In FIG. 6 this is the laying bar 56, that is being turned in a clockwise direction in the Figure as marked by the arrow. In the case of the direction of motion as marked by arrow 95 in FIG. 4, the freewheel 93 is in operation, whereas the freewheel 92 is being freely turned. The laying bar 55 is spaced from the ply 802 nearest to it by a distance a equal to the thickness of the web.

When after running through the reversal plane 79 (without any change in the direction of motion of the chains 66 as marked by arrow 78) the direction of turning of the sprocket wheels 91 and 96 is reversed, the freewheel 92 will come into operation and the laying bar 55 will be turned in the direction of the arrow 97 while rolling along on the next top ply of web on the stack, whereas the laying bar 56 will be clear of the ply 801.

Figure 2:
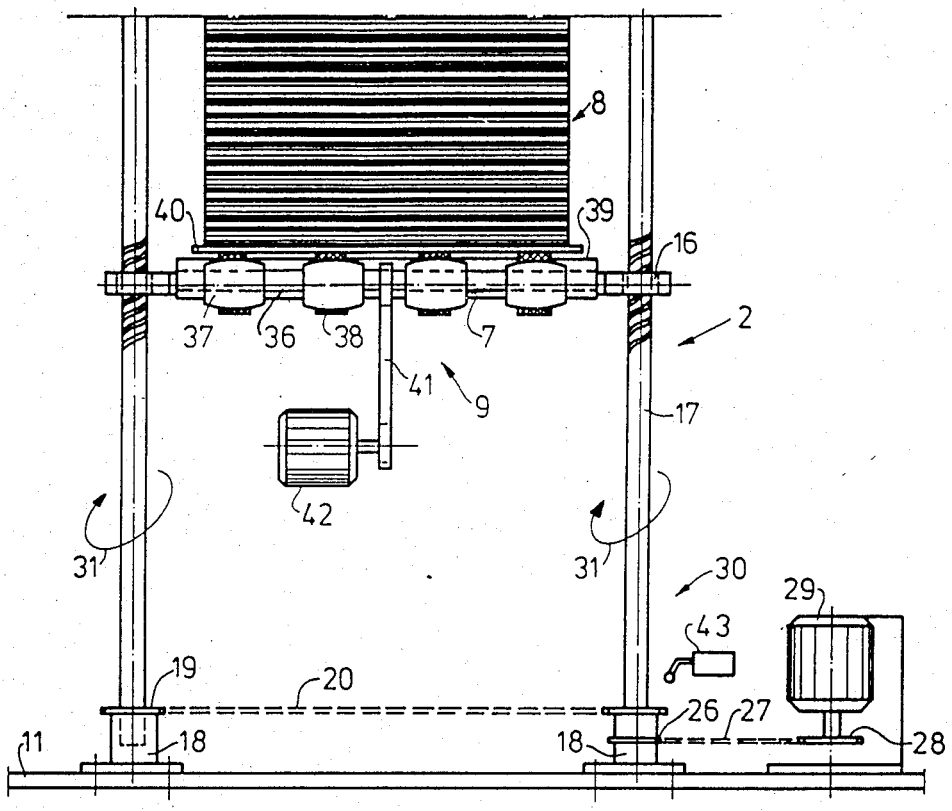
FIG. 2 is an enlarged partial elevational view of the support table with the means for raising it taken from the left of FIG. 1.
Figure 3:
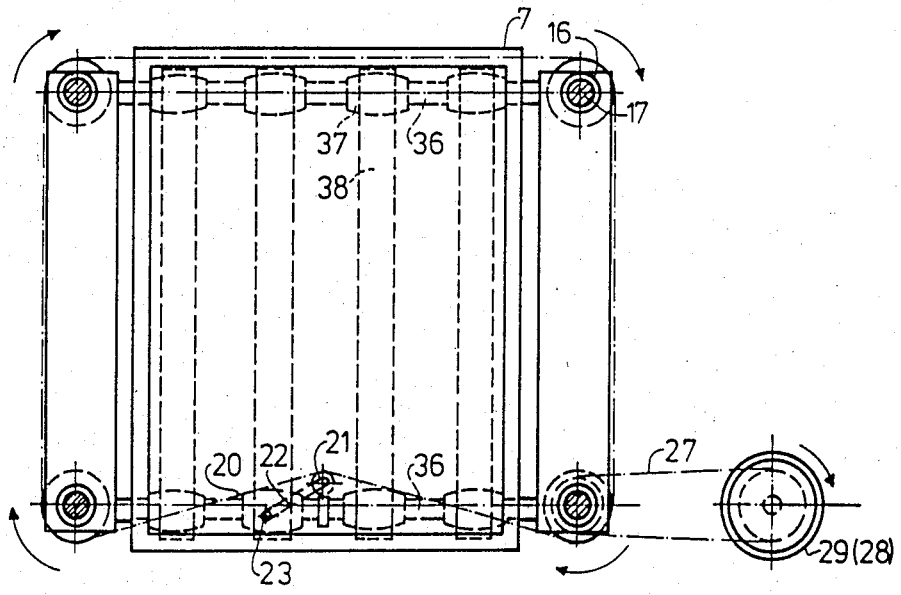
FIG. 3 is a top plan view of the system seen in FIG. 2.

This clearance a is produced because there are two limit switches 98 and 99 in the path of motion of the guide rails 76, such switches being operated each time the guide rails are at short distance before the reversal planes 79 and 81. Such an operation of the limit switches puts an adjustable timer into operation as noted earlier so that the lifting motor 29 is switched on in its lowering direction for such a (short) time that the table 7 is lowered through the said distance a equal to the thickness of a ply. This lowering action will go on in steps until in the end the limit switch 43 (see FIG. 2) of the clearing conveyor 9 will be put into operation.

The tenter

In keeping with actual needs the cuttling machine of the present invention may be employed for the folding of single ply or multi-ply webs or fabrics. For flat tubular webs the tenter 100 or internal web stretcher seen in FIGS. 5, and 8 is quite different, which is made up of two flat metal gallows 101 and 102 that have their inwardly pointing ends 103 sliding on each other and adjustably locked by a clamp so that the tenter 100 has two legs 104 and 105 that are more or less parallel. The free ends of the legs 104 and 105 have support casters 106. There are brackets 108 fixed to the inside sides of the legs 104 and 105 for carrying further support casters 107.

Figure 7:
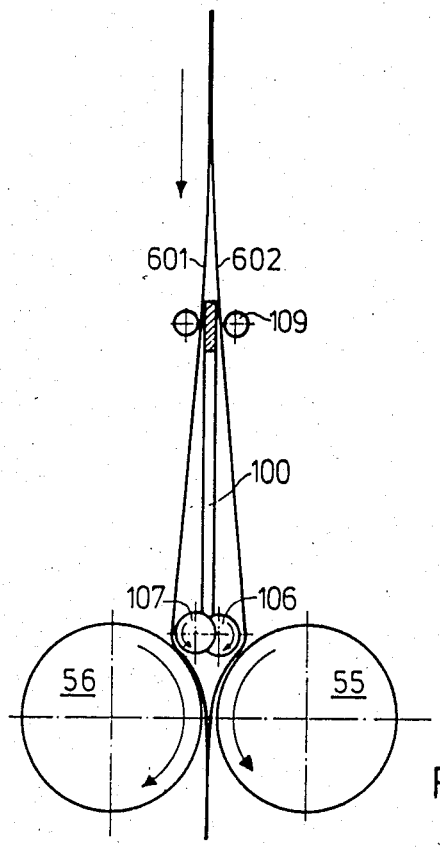
FIG. 7 is a view of a tenter or internal web stretcher in its operational position as seen from the right in FIG. 5.

The two sides or walls 601 and 602 of the flat tubular web 6 are passed around the tenter 100 within them and come together again under the support casters 106 and 107. It is by way of these casters that the tenter or brace is supported over the gap 57 with the web layers 601 and 602 between the casters and the bars 55 and 56. As will furthermore be seen from FIG. 7, the casters 106 and 107 have their axes somewhat out of line from each other in a direction normal to the plane of the tenter 100. The casters 106 are supported on the laying bar 55 and the casters 107 are on the laying bar 56. To see that there is no danger of the tenter 100 falling over sideways, its top end is guided between two thin rods 109 which, as will be seen from FIG. 1, take effect when the web is bent at the end of the stroke of the laying carriage.

As will be seen from FIG. 5 there are furthermore guide rollers 110 for acting against the legs 104 and 105 of the tenter 100. These rollers 110 have grooves in their outer edges to fit onto the sides of the tenter. As marked by the double arrow 111 these rollers may be moved and locked on a rod 112 that is mounted between the side plates 49. They keep the tenter 100 in the position to which it has been set.

The cooling unit

The cooling unit 4 has a woven wire belt 116 that is supported on the top ends of the struts 14 and 15 by way of level beams 118. The drive for the belt 116 is taken from the shaft 69 by way of a chain 117 running within the box-like leg 15 (see FIG. 1). There is a cooling hood 119 placed right over the top run of the belt 116 forming a support for the web 6. Air from the room is propelled at a gage pressure into the hood 119 by a cooling blower 121 placed on the hood and driven by a motor 120.

The cooling hood 119 has a level floor 122 with evenly distributed air outlet holes 123 therein, through which high velocity jets 124 of air under a gage pressure are blown downwards and air is blasted onto the web 6 right under the plate 122. As the air comes out of the holes it expands and its temperature drops down to room temperature so that the web 6 is cooled down to room temperature as well. At the same time the air takes up moisture from the web 6 so that it is dried and is permanently relaxed and set and when the web is laid it will keep permanently to the folded form. In this connection the woven wire belt 116 is run at a speed that is below that of the supply speed of the web 6.

It may however be expedient to make adjustments to this speed manually (that is to say as opposed to automatically) so that the speed is right for different types of web and is in line with the speed of delivery from a textile finishing machine supplying the folding machine, or with the speed of a master drive of such machine. To make this possible it is best if the speed of the laying motor 70 is steplessly variable, for example if the motor is in the form of a DC. motor supplied from a phase chopping thyristor controller so that the speed is a function of the speed of the supply speed of the web 6. For such a control system there may be a tachogenerator which is driven by the web itself or by a drive supplying the web towards the cuttling machine.

The drive system from the laying motor 70 to the wire belt 116 does normally not need any regulation, although it would be possible to have an ajustable transmission with a very small speed variation range; such adjustment might for example be made possible by changing the sprocket wheels for the chain 117 or by using a stepless transmission.

Operation of the machine

Before the machine is turned on and more specially before starting up the laying motor 70, its speed setting is adjusted empirically in keeping with the nature and size of the web to be folded. Furthermore the timer, that is responsible for control of the lifting motor 29 in steps, will be set in keeping with the size and nature of the web.

The textile finishing machine from which the web 6 is being supplied may have a master drive from which, when the complete plant has been started, all speeds of different units will be controlled. The web 6 is advanced using the wire belt 116 till it is hanging down near the laying bars 55 and 56.

Then the tenter 100 is taken off the machine and set to the breadth of the flat tubular web and placed in it. With the laying bar 56 in the open position the lower end of the web is threaded between the two bars 56 and 55 and when the gap between them has been closed again to its operational width the tenter 100 is placed on the laying bars. The free end of the web is tucked around under that bar which is responsible for laying it when the machine is started. In this respect the table 7 may be moved upwards until the ply of web thereon is resting up against the laying bar that is in operation.

After the start of the laying operation the machine operator has to make a careful check and examination of the passage of the web through the machine at a reduced speed of operation. If the speed of the machine is dependent on a master drive of a textile finishing machine, the speed of the laying motor 70 has to be carefully adjusted to get the required degree of loosening of the web before it is supplied to the laying unit. Using the degree of compression or density of the stack 8 first formed as a guide, the selection of the amount of lowering of the stack in each lowering step is then checked and if necessary corrected until the machine is working in the desired way so that it may now be run up to its full operating speed.

To produce a stack 8 of the full height it is normally necessary for more than one piece of web 6 to be folded. Because the clearing of the stack off to the side and the lifting of the table are done at a high speed and do not cause any delay, the formation of the next stack may be commenced at once without any interruption in the operation of the machine. The regularity of laying is also not in any way impaired thereby.

I claim:

1. A machine for folding continuously supplied textile web in a stack comprising:

a frame;

a substantially horizontal stack support table;

means connected to said table for supporting said table for vertical stepwise movement downwardly and for the return of said table to an uppermost position;

a carriage movably mounted on said frame for reciprocating movement with respect to said frame and table parallel to the plane of said table;

carriage guide means mounted on said frame for supporting and guiding said carriage in said reciprocating movement;

a pair of web feeding bars rotatably mounted on said carriage directly adjacent the top of the stack in parallel spaced relationship with their axes of rotation parallel with respect to each other and perpendicular to the direction of reciprocation of said carriage;

two gear wheels rotatably mounted on said frame on opposite sides of said carriage;

an endless chain operatively engaging said two gear wheels to be driven thereby in a closed loop with the portions thereof between said gear wheels being parallel to the direction of reciprocation of said carriage;

a sliding member mounted on said chain;

a slide on said carriage extending perpendicular to said direction of reciprocation slidably engaging with said sliding member to form a sliding connection between said chain and carriage;

means to rotate one of said gear wheels for reciprocating said carriage on said carriage guide means at regular intervals on an unchanging horizontal path of travel so that textile web fed through the space between said bars is deposited on said table in a folded manner;

means connected to said table supporting means for lowering said table in stepwise manner so that each lowering step commences at the end of each reciprocating stroke of said carriage and is equal to a whole number based on unity of thickness of the web being folded;

at least one rack mounted on said frame;

toothed wheel means operatively engaging said rack; and freewheel means operatively connecting said toothed wheel means to said bars for driving said bars, so that reciprocation of said carriage causes said toothed wheel means in engagement with said rack through said freewheel means to rotate one of said bars in the feeding direction of rotation and the other of said bars to freewheel in one direction of reciprocation of said carriage, and the other of said bars to rotate in the feeding direction of rotation and said one bar to freewheel in the other direction of reciprocation of said carriage in continuous succession of alternate operations to produce said folding.

2. The folding machine as claimed in claim 1 wherein:

said at least one rack comprises a double pintle chain having two rows of pintles forming separate rack members;

said toothed wheel means comprises two sprocket wheels each operatively connected to a respective one of said bars.

3. The folding means as claimed in claim 1 and further comprising:

a tenter in the form of a flat tube positioned over the gap between said bars having an upper portion adapted to be placed in the web and a lower portion adjacent said bars; and casters rotatably mounted on said lower portion and engaging said bars adjacent said gap for supporting said tenter.

4. The folding machine as claimed in claim 3 wherein said tenter has two sides each having a lower end and a pair of said casters on each lower end, the casters on each lower end having axes that are out of line in a plane normal to the plane of the tenter.

5. The folding machine as claimed in claim 3 and further comprising: two guide casters engageable with an upper portion of said tenter and slidably mounted on a rod mounted at its ends on said carriage to be adjusted in a direction normal to the axes thereof.

6. The folding machine as claimed in claim 1 wherein:

said carriage guide means comprises two parallel rods mounted at the ends on said frame; and linear ball bearings mounted on said carriage and operatively engaging said rods to move therealong.

7. The folding machine as claimed in claim 1 and further comprising:

limit switch means operatively disposed with respect to said carriage to engage said carriage in predetermined positions thereof for controlling the stepwise lowering of said table; and further limit switch means disposed to engage said table in a lowered position thereof for reversing the direction of said table to raise it to the upper position.

8. The folding machine as claimed in claim 7 and further comprising:

reversible motor means operatively connected to said table for vertically moving said table, said motor being reversible by reversing polarity of electric current applied to the motor so that the table is moved upwardly four times faster than it is lowered.

9. The folding machine as claimed in claim 8 wherein said table is rectangular and said means for supporting said table comprises:

a vertically extending drive screw adjacent each corner of said table;

means for rotatably supporting said drive screws at the lower ends thereof;

cooperating screw threaded nut elements on said table engaging said drive screws; and means operatively connecting said drive screws to said motor means to be rotatably driven thereby.

10. The folding machine as claimed in claim 1 and further comprising:

a clearing conveyor operatively associated with said table for moving a completed stack of folded web sideways from said table;

means connected to said conveyor for operating said conveyor; and a limit switch disposed to engage said table at the lower end of the vertical movement thereof and operatively connected to said conveyor operating means to actuate said conveyor at said lower end of movement of the table.

11. The folding machine as claimed in claim 10 wherein said clearing conveyor comprises:

a plurality of transport belts running over the top of said table;

pallet means disposed under said stack of folded web and engaging the tops of said belts; and means driving said belts.

* * * * *